US009754467B1

(12) United States Patent
Harrison

(10) Patent No.: US 9,754,467 B1
(45) Date of Patent: Sep. 5, 2017

(54) INTERACTIVE NOTIFICATION SYSTEM FOR REMOTE CONTROL OF A GUN SAFE OR THE LIKE

(71) Applicant: Richard James Harrison, New Milford, CT (US)

(72) Inventor: Richard James Harrison, New Milford, CT (US)

( * ) Notice: Subject to any disclaimer, the term of this patent is extended or adjusted under 35 U.S.C. 154(b) by 267 days.

(21) Appl. No.: 14/337,712

(22) Filed: Jul. 22, 2014

Related U.S. Application Data

(60) Provisional application No. 61/899,930, filed on Nov. 5, 2013.

(51) Int. Cl.
*G08B 13/22* (2006.01)

(52) U.S. Cl.
CPC ..... *G08B 13/22* (2013.01)

(58) Field of Classification Search
CPC .. E05G 1/00; E05G 1/024; E05G 1/10; E05G 1/005; E05G 1/026; E05G 1/04; E05G 1/06; E05G 1/08; Y10T 70/5097; Y10T 70/5372; Y10T 70/7102; A47B 81/005; A47B 47/03; A47B 57/42; E05Y 2900/602; E05Y 2400/66; E05Y 2900/604; G08B 13/19697; G08B 13/19632; G08B 15/02; G08B 13/19604; G08B 13/19606; G08B 13/19645; G08B 13/19656; G08B 13/19673; G08B 13/1968; G08B 13/19682; G08B 13/19695; G08B 21/0286; G08B 21/245; F41C 33/06; F41C 33/0209; F41C 33/0227; F41C 33/0263; F41C 33/029; F41C 33/041; G07C 9/00126; G07C 9/00912; G07C 9/00166; G07C 9/00571; E05B 65/0075; E05B 45/06; E05B 47/00; E05B 65/462; E05B 65/52; E05B 73/00; F41A 23/18; F41A 17/063; H04N 21/4223; A45C 13/18; B65D 2211/00; B65D 88/528; B65D 90/22; G06Q 20/102; G06Q 20/20; G06Q 9/00166; G06Q 9/00571; G07F 17/12; G07F 11/0069; G07F 9/026; G07F 11/002; E05F 15/77

USPC ..... 340/5.52, 5.83, 5.73, 522
See application file for complete search history.

(56) References Cited

U.S. PATENT DOCUMENTS 5,161,396 A 11/1992 Loeff
5,416,826 A * 5/1995 Butler ..... F41A 23/18 340/542
5,598,151 A * 1/1997 Torii, Jr. ..... A47B 81/005 340/5.33

(Continued)

FOREIGN PATENT DOCUMENTS

GB 2427319 A * 12/2006 ..... G08B 13/19613

*Primary Examiner* — Fekadeselassie Girma
(74) *Attorney, Agent, or Firm* — Wendy W. Koba

(57) ABSTRACT

An interactive notification system allows the owner of a safe (or any type of vault for protecting personal property) to be contacted when an alarm condition is triggered. The system is configured to respond to a return message signal from the owner to either allow or deny any continued action with the safe. Thus, the owner remains in control of all actions involving the safe, regardless of his physical location. The notification is typically sent electronically to one or more of the owner's communication devices (phone, tablet, computer, etc.), where the owner responds via the same method.

12 Claims, 4 Drawing Sheets

(56) References Cited

U.S. PATENT DOCUMENTS 5,774,058 A * 6/1998 Henry ..... G07C 9/00015 109/32
6,040,771 A * 3/2000 Kim ..... E05G 1/10 340/5.31
6,400,265 B1 * 6/2002 Saylor ..... G08B 13/19602 340/506
6,510,642 B2 1/2003 Riener
6,791,451 B1 * 9/2004 Muise ..... G08B 25/10 340/10.1
6,885,281 B2 * 4/2005 McGunn ..... E05G 1/00 340/5.28
7,116,224 B2 * 10/2006 Mickler ..... F41C 33/06 109/38
7,295,110 B2 * 11/2007 Mercier ..... G07G 1/0054 340/545.1
7,850,076 B1 * 12/2010 Dorenbaum ..... G06Q 40/02 109/2
8,186,188 B1 5/2012 Brown
8,860,568 B1 * 10/2014 Baker ..... G08B 13/06 340/3.1
8,875,176 B2 * 10/2014 Hill ..... G01S 19/17 725/106
8,922,335 B2 * 12/2014 Deweese ..... H04N 7/188 109/38
9,316,039 B2 * 4/2016 Stevenson ..... E05G 1/04
9,317,987 B2 * 4/2016 Cleveland ..... G07C 9/00912
2002/0147598 A1 * 10/2002 Smith ..... G06Q 20/102 235/379
2003/0104822 A1 * 6/2003 Bentley ..... H04M 3/42 455/456.1
2005/0204787 A1 * 9/2005 Ernst ..... E05G 1/10 70/278.7
2006/0152339 A1 * 7/2006 Mercier ..... G07G 1/0054 340/5.73
2007/0191983 A1 * 8/2007 Griffits ..... A47G 19/2227 700/213
2007/0198850 A1 * 8/2007 Martin ..... G07C 9/00087 713/186
2007/0250920 A1 * 10/2007 Lindsay ..... G06F 21/31 726/7
2007/0273534 A1 * 11/2007 McGinn ..... G06Q 10/00 340/572.8
2008/0007431 A1 * 1/2008 Jacques ..... G08B 19/00 340/984
2008/0052044 A1 * 2/2008 Shoenfeld ..... E05B 65/52 702/188
2009/0165682 A1 * 7/2009 Cleveland ..... G06F 21/86 109/23
2009/0167536 A1 * 7/2009 Clark ..... B63C 9/00 340/573.4
2010/0042437 A1 * 2/2010 Levy ..... G06Q 10/087 705/3
2010/0179389 A1 * 7/2010 Moroney, III ..... G06F 19/3406 600/301
2010/0295665 A1 * 11/2010 Landau ..... G06Q 10/087 340/10.42
2011/0079170 A1 * 4/2011 Al-Mutairi ..... E05G 1/06 109/23
2011/0175730 A1 * 7/2011 Stevenson ..... E05B 47/00 340/540
2011/0279225 A1 * 11/2011 Frontino ..... G07D 11/0066 340/5.3
2012/0013464 A1 * 1/2012 Roberts ..... G08B 13/08 340/541
2012/0137706 A1 * 6/2012 Hussain ..... G06K 19/07749 62/3.6
2013/0033381 A1 * 2/2013 Breed ..... B60T 1/005 340/568.1
2013/0264128 A1 * 10/2013 Plato ..... E05B 39/00 177/132
2013/0293368 A1 * 11/2013 Ottah ..... G08B 23/00 340/426.1
2013/0298807 A1 * 11/2013 Wall ..... E05G 1/024 109/38
2014/0196636 A1 * 7/2014 Deweese ..... E05G 1/04 109/23
2014/0197954 A1 * 7/2014 Caputo ..... G06K 7/10366 340/572.1
2014/0285668 A1 * 9/2014 Deweese ..... H04N 7/188 348/156
2014/0326764 A1 * 11/2014 Roach ..... B60R 9/065 224/404
2015/0081362 A1 * 3/2015 Chadwick ..... G06Q 50/30 705/7.14
2016/0053526 A1 * 2/2016 Dittrich ..... E05G 1/026 109/38

* cited by examiner

| CONTROL SIGNAL | ALARM MESSAGE | DEV1 | DEV2 | DEV3 |
|---|---|---|---|---|
| TOUCH | | | | |
| OPEN | | | | |
| MOVE | | | | |

| RECEIVED MESSAGE | CONTROL SIGNAL RESPONSE |
|---|---|
| OK | ALLOW |
| DENIAL, NO ACTION | DENY |
| DENIAL, ACTION | DENY, CALL 911 |

INTERACTIVE NOTIFICATION SYSTEM FOR REMOTE CONTROL OF A GUN SAFE OR THE LIKE

CROSS-REFERENCE TO RELATED APPLICATIONS

This application claims the benefit of U.S. Provisional Application Ser. No. 61/899,930, filed Nov. 5, 2013 and herein incorporated by reference.

TECHNICAL FIELD

The present invention relates to an interactive notification system that allows the owner of a safe (or any type of vault for protecting personal property) to be contacted when any alarm condition is triggered, and requiring a response signal from the owner to either allow or deny any continued action with the safe.

BACKGROUND OF THE INVENTION

In light of the on-going tragedies surrounding gun violence, it is of paramount importance that licensed gun owners have peace of mind that their registered firearms are safely and securely locked within a gun safe (vault, case, etc.) at a secure location at all times. This is necessary to reduce a gun owner's worries when away from home (e.g., concerns such as someone breaking into the home and cracking open a gun safe to remove firearms), as well as to prevent unauthorized individuals from accessing the firearms even when the owner is home (e.g., children, contractors working at the home, etc.).

Beyond the concerns of gun owners, anyone that stores valuables in an on-premises safe has worries about untoward individuals breaking into and stealing items when the owner is out of town.

SUMMARY OF THE INVENTION

The present invention is directed to a system that helps to alleviate the concerns mentioned above and, more particularly, relates to an interactive notification system that allows the owner of a safe (or any type of vault for protecting personal property) to be contacted when any alarm condition is triggered, and requiring a response signal from the owner to either allow or deny any continued action with the safe.

In particular, the present invention relates to a system for notifying an owner of a safe when any action associated with the safe transpires (e.g., attempting to move the safe, open the safe, perhaps even just touching the safe). The system is configured to wait for a response from the owner before allowing any further actions involving the safe to progress. Thus, the owner remains in control of all actions involving the safe, regardless of his physical location. The notification is typically sent electronically to one or more of the owner's communication devices (phone, tablet, computer, etc.), where the owner responds via the same method. For example, a telephone call-based notification and control system may be employed. As described below, the system is configured to be located within the confines of the safe itself, thus preventing any possibility of tampering with the control system. In one configuration, the system itself may include a "disable" switch that is also located within the safe—allowing the owner to deactivate the control system when desired.

One particular embodiment of the present invention comprises an interactive notification and alarm system to prevent the possibility of tampering with a safe, removing a safe from the premises, or even removing selected items from a safe. The interactive notification and alarm system comprises at least one sensor module for recognizing the occurrence of all activities, including a predetermined undesirable activity, which generates an alarm signal as soon as the predetermined activity occurs. A control module within the alarm system is coupled to the sensor module(s) and in response to the generation of an alarm signal by the sensor module, the control module initiates a transmission of an alarm message to at least one communication device associated with an owner of the safe. Thus, the owner is provided with an alert of the occurrence of the undesirable activity. The control module is also responsive to a return message from the owner, and uses the content of the return message to initiate a predetermined response action (e.g., "call authorities", or "permit access", etc.).

Other and further embodiments and arrangements of the present invention will become apparent during the course of the following discussion and by reference to the accompanying drawings.

BRIEF DESCRIPTION OF THE DRAWINGS

Referring now to the drawings, where like numerals represent like parts in several views.

DETAILED DESCRIPTION

Figure 1:
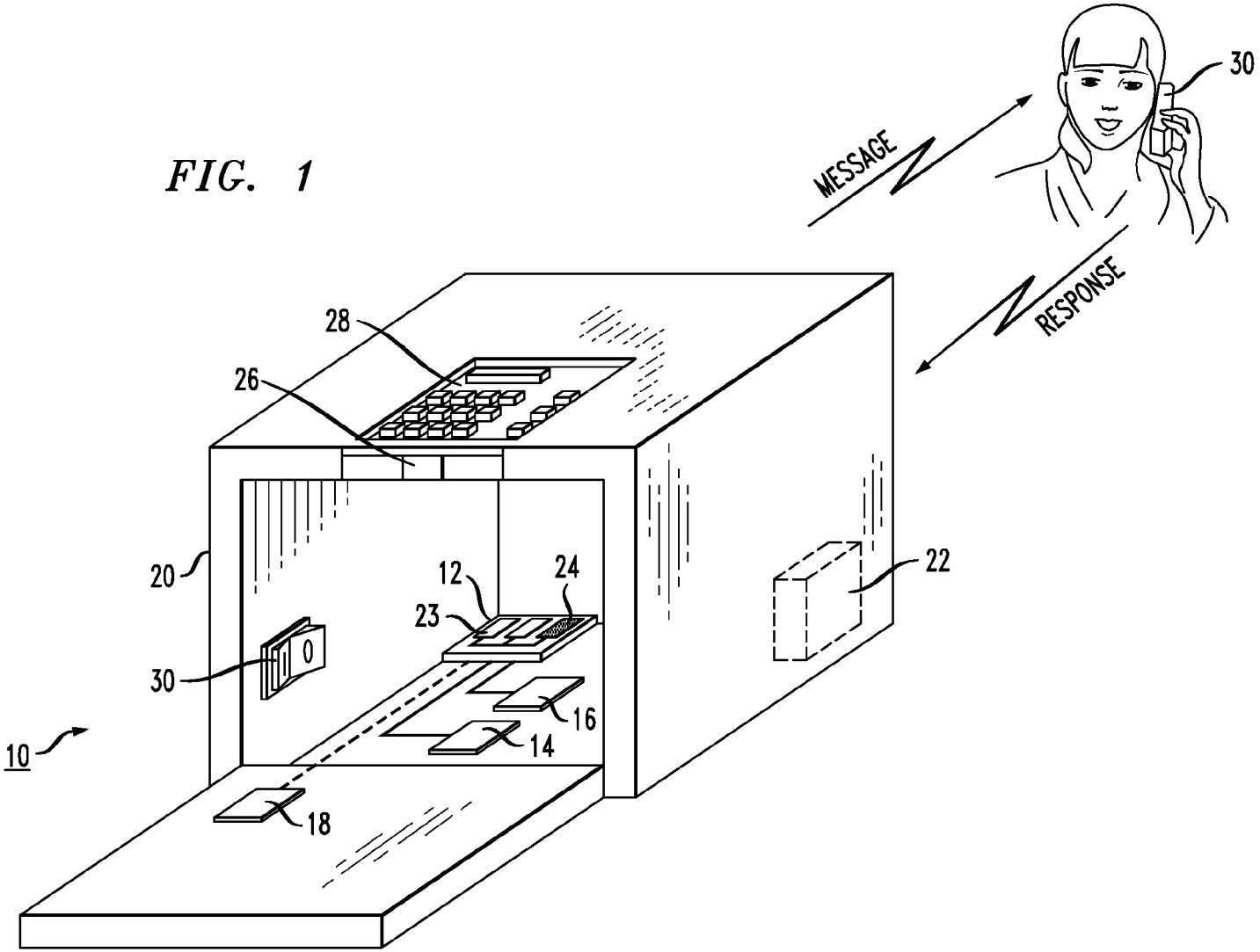
FIG. 1 illustrates an exemplary interactive notification system for remote control of a safe (or any type of secure vault or similar container) formed in accordance with the present invention.

FIG. 1 illustrates an exemplary interactive notification and control system 10, formed in accordance with an embodiment of the present invention. In this embodiment, notification and control system 10 includes a number of separate subsystem modules, including a control module 12 for processing various signals (as well as providing bi-directional communication with the owner of the safe), a touch sensor module 14, a motion sensor module 16 and a "door open" sensor module 18. Modules 14, 16 and 18 are all coupled to control module 12 and are configured to send alarm signals to control module 12 upon the recognition of an unusual condition involving the safe. All of these components are located within a safe, shown as a vault 20 in FIG. 1. While capable of being powered by a conventional electric outlet, a preferred embodiment of control and notification system 10 utilizes a battery module 22 that is co-located with system 10 within the safe.

In one possible configuration, it is possible to also include some type of ON/OFF switch 30 with system 10, where switch 30 would also be located within the safe. This switch would be used by the owner to deactivate control and notification system 10. It is to be understood that this deactivation is completely under the control of the owner, and is located within the safe such that others cannot tamper with the switch.

As will be described in detail below, various other embodiments of the present invention may include more or less modules, as desired by the owner. For example, it is possible that an owner only cares if the safe is opened, and does not care if the safe is moved from one location to another. In this arrangement, perhaps only control module 12 and "door open" sensor module 18 would be required.

In explaining the operation of the system as shown in FIG. 1, suppose that someone has touched the safe (this includes, in most cases, the owner him or herself touching the safe). This "touch" activity will be recognized by touch sensor module 14, which then transmits an alarm signal to control module 12. At this point, a communication element 24 within control module 12 will transmit a specific alarm message to a communication device 30 associated with the owner (such as, for example, the owner's smartphone). The specific alarm message will be something like "SAFE 123 HAS BEEN TOUCHED" and will preferably include a timestamp (in response to signals from other modules, another alarm message may be "SAFE 123 HAS BEEN OPENED". As will be discussed in detail below, it is possible that communication element 24 may send multiple messages to a variety of devices associated with the owner, to insure that the message is indeed received. For example, an email may be sent to the owner's laptop computer, a text message to his smartphone, and a SMS message to another electronic account. In most cases, communication element 24 will also retain a record of the alarm incident, allowing the owner to later download and retrieve all alarms received during a selected time interval.

Returning to a description of the operation of interactive notification and control system 10, upon receipt of an alarm message by owner's communication device 30, the owner can respond with a variety of commands, such as "OK" (if the owner himself has touched the safe, for example), "UNLOCK" (if the owner gives permission for someone to access the safe), "DENY, but no ALARM" (if the owner knows that the situation does not warrant further action), or "DENY, NOTIFY AUTHORITIES" (if the owner is not on premises and no one else has been given permission to access the safe).

While this scenario is based upon module 14 recognizing a "touch" anywhere on the outer surface of vault 20, system 10 of the present invention may be specifically configured to restrict the region where a "touch" activity will trigger the sending of a notification to the owner (such as a lock region 26). Indeed, the "touch" may be limited to someone attempting to entering the combination of the safe on a keypad (or dial) 28. In another scenario, an impermissible movement of the entire safe itself will result in triggering a motion alarm by module 16. If the safe is somehow opened, the "door open" sensor module 18 will likewise send an alarm signal to control module 12, causing communication element 24 to send a message such as "DOOR OPEN—SAFE 123" to one or more of the owner's communication devices.

In accordance with the present invention, the interactive notification and control system allows for the owner to maintain control of all actions involving his/her safe and its contents. Preferably, the system also includes a "time out" feature such that if the owner does not respond to a notification within a predefined period of time (i.e., a few minutes), the system will send an alarm signal to the authorities. An exemplary flow chart describing the use of the inventive system is shown in FIG. 2 and includes this "time out" feature.

Figure 2:
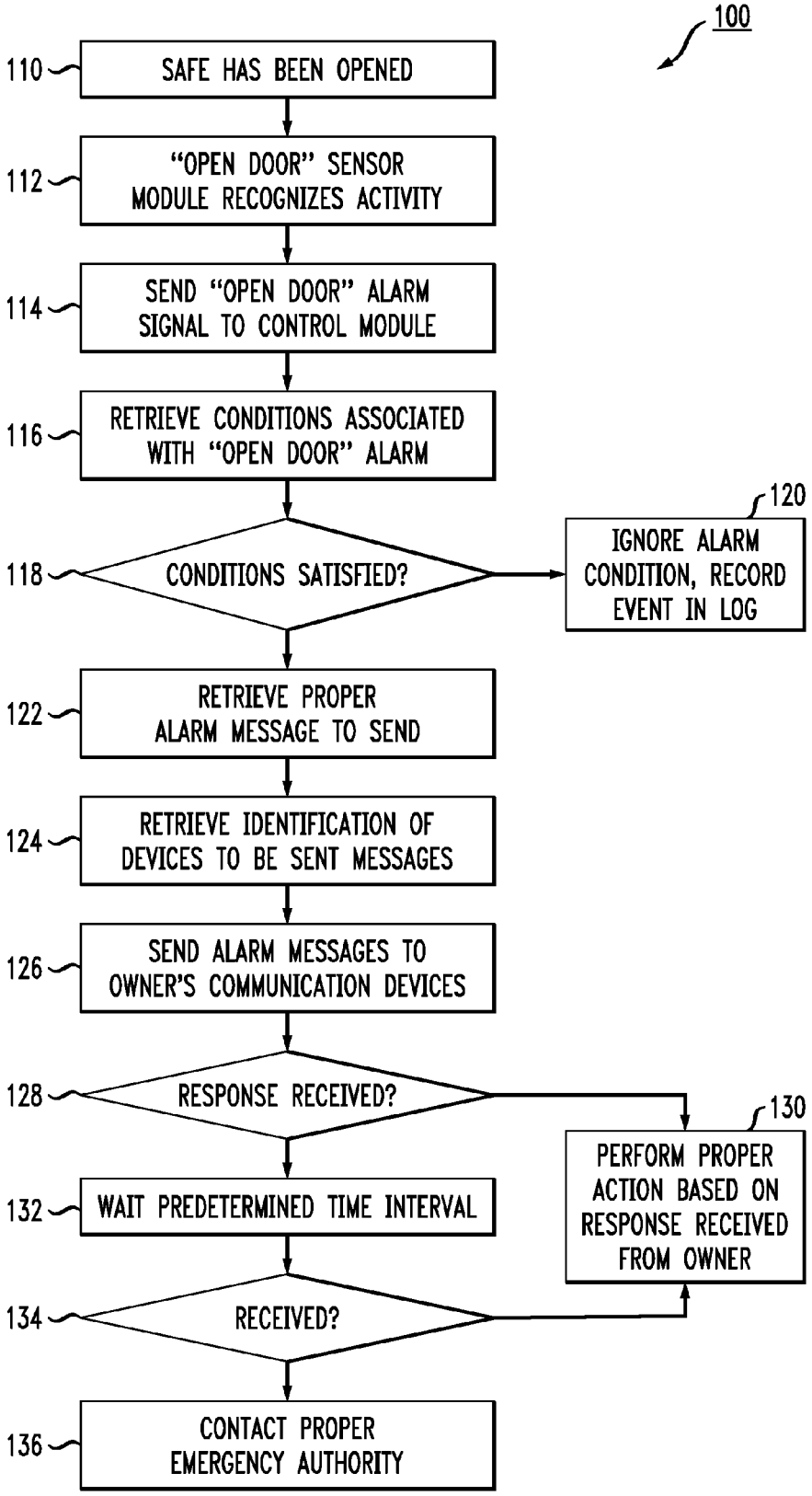
FIG. 2 is a flow chart of an exemplary process for utilizing the interactive notification system of FIG. 1.

In particular, FIG. 2 contains a flowchart 100 showing an exemplary set of process steps that may be followed in the operation of the interactive notification and control system of the present invention. For this example, it is presumed that someone has opened a safe that is secured by the system of the present invention (shown as step 110 in FIG. 2). The act of opening the safe will activate "door open" sensor module 18 (step 112), which then responds by sending a "door open" alarm signal to control module 12 (step 114).

At this point, control module 12 may search through a local memory 23 to determine if a "door open" alarm signal has been defined by the owner as one of the signals for which he/she would like to receive an alarm. This action is shown as step 116, and should be considered as "optional". In the default case, it can be presumed that any alarm signal received by control module 12 will be directly transmitted to a communication device 30.

Continuing with the description of FIG. 2 and presuming that a check is made as shown in step 116, control module 12 makes a decision (step 118) based on the retrieved information from local memory 23. If the retrieved information indicates that an alarm message does not need to be sent (step 120), control module 12 may just record the event and return to its "waiting" mode.

Presuming that the retrieved information from local memory 23 indicates that an alarm message should be sent, control module 12 then selects the proper message for communication element 24 to send (in this case, including the phrase "door open"), shown as step 122. Control module 12 also retrieves (from local memory 23, for example) an identification of each of the owner's communication device(s) that is to receive the alarm message, as well as the proper communication format for each device (step 124). For example, if an alarm message is to be sent to a smartphone, a "text message" may be the selected format. Alternatively, a "voice call" may be the selected format for communicating with a smartphone (or, perhaps, both formats may be selected). An SMS message is another possibility, sent to devices such as smartphone or tablet. An email message may be the proper format for sending an alarm message to a personal computer. Indeed, any possible communication channel and message format may be used that is capable of providing bi-directional communication in accordance with the present invention.

At this point, control module 12 functions to send, via communication element 24, one or more "door open" alarm messages to the owner's designated communication devices (step 126). Once transmitted to the owner, the process then waits for a reply (shown as decision step 128). Upon receipt of a response, shown as step 130 in the flowchart of FIG. 2, control module 12 will then take the appropriate action as requested by the owner (exemplary responses may include "access approved, unlock safe", "access denied, take no action", "access denied, call 911", etc.).

In accordance with the "time out" feature mentioned above, the process may include a 'wait' interval (shown as element 132 in FIG. 2) for which the system will wait for a response from the owner. If no response is received during this response interval (monitored at step 134), control module 12 proceeds at step 136 to send an "alarm" notification to proper personnel (which may be the local 911, an alarm company associated with the owner's property, or another other designated emergency authority). The time period associated with "wait" step 132 may be pre-programmed into the system or, alternatively, selectable by the owner. For example, a time period of 3 minutes may be selected as a response period.

Figure 3:
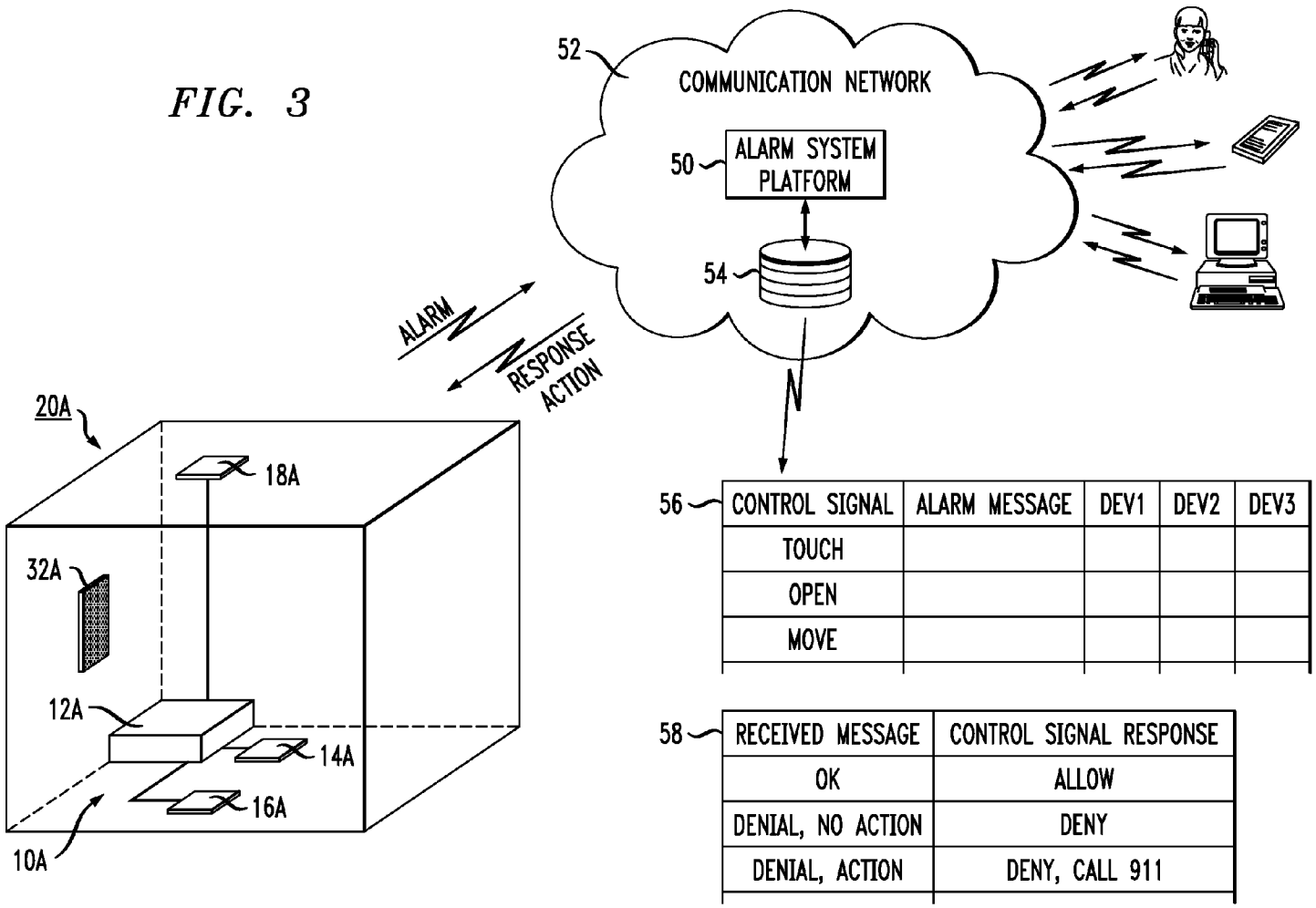
FIG. 3 illustrates an exemplary network architecture showing a deployment of the system of the present invention.

It is contemplated that the various process steps involved in implementing the features of the present invention may be embodied as an "application" that could be downloaded onto an owner's mobile device. FIG. 3 is a simplified network architecture diagram illustrating one possible configuration of the present invention that may include the utilization of a mobile phone app. In this example, a vault 20A is shown as including an interactive notification and alarm system 10A, including control module 12A and sensor modules 14A, 16A and 18A, the sensor modules being similar to the arrangement described above in association with FIG. 1. Also shown in FIG. 3 is a GPS unit 32A, which may be disposed within vault 20A and thereafter used by the owner (or law enforcement authorities) to track the location of the vault if it is stolen.

In this case, however, control module 12A does not perform any local processing of the received alarm signals from the modules. Instead, control module 12A directly communicates the received messages to an alarm system platform 50 which is located in a communication network 52. The transmitted messages can be relatively short, including an identification of the vault experiencing the alarm condition and the type of alarm message (e.g., Owner XYZ's vault is experiencing a "motion" alarm condition).

Using well-known signal processing techniques, alarm system platform 50 utilizes the identification "XYZ" to retrieve the proper information regarding that owner from, for example, a database 54. Shown in FIG. 3 are different records that may be stored in database 54 and associated with owner XYZ. Record 56 includes a set of possible received alarm signals (including "motion"), with the desired alarm message to be sent upon receipt of each different alarm signal. In this particular embodiment, the identification of each communication device association with owner XYZ is also listed in database record 56, allowing for the proper signal format to be used. In this case, only XYZ's smartphone is registered, with the request to send a text message.

Also shown in FIG. 3 is a second record 58 associated with owner XYZ, in this case including a set of the various response messages received from XYZ, and a listing of the proper response message to be forwarded to control module 12A.

It is to be understood that this network-based application is only exemplary of one implementation of the principles of the present invention; various other configurations may be contemplated and used to perform the interactive notification and control actions associated with the alarm system of the present invention.

Figure 4:
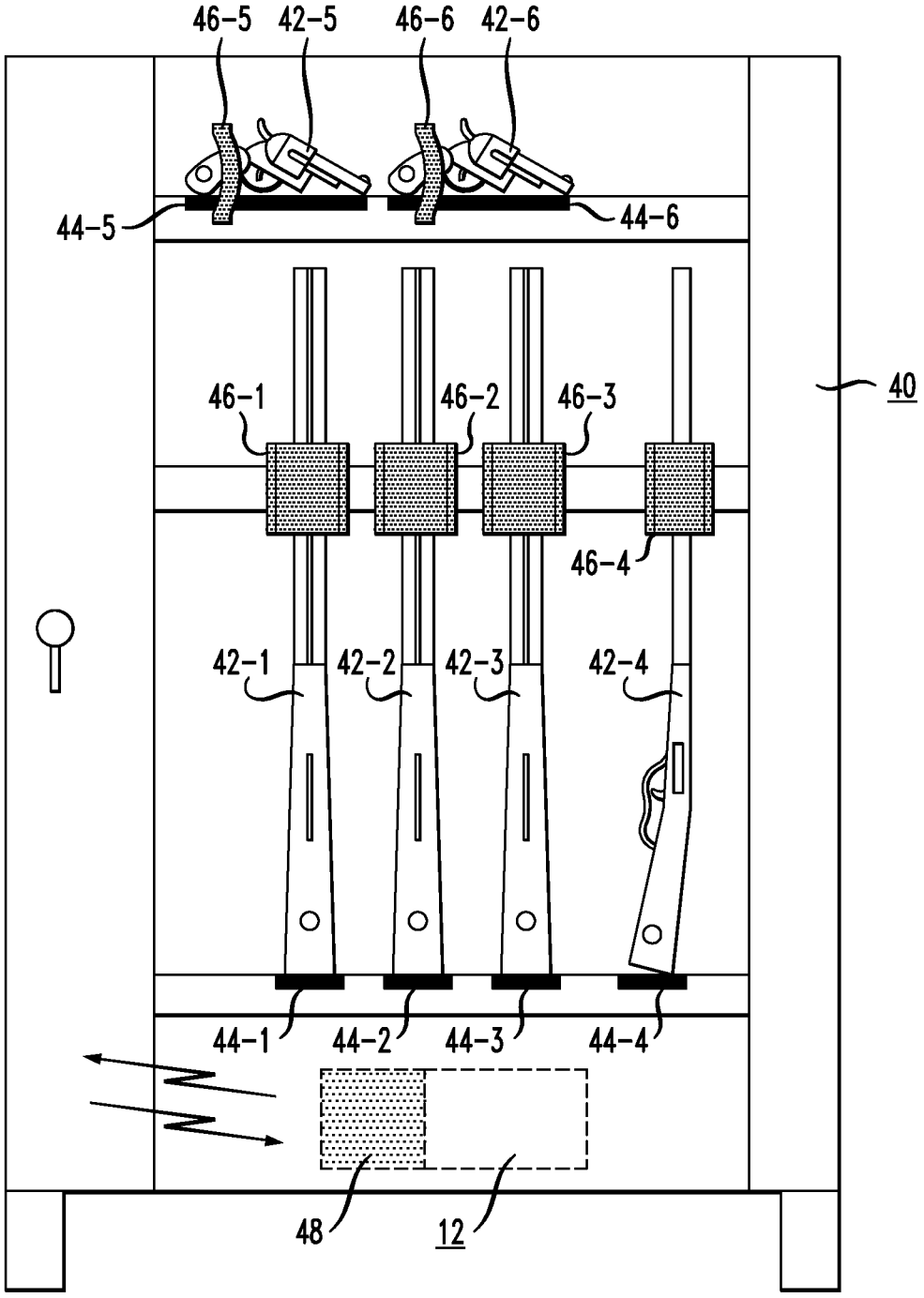
FIG. 4 illustrates an alternative embodiment of the present invention including sensor elements associated with specific items stored in a safe.

In a further embodiment of the present invention, a separate sensor element may also be associated with each item contained in a safe, in a one-to-one configuration, such that an owner may also be notified when one or more specific items have been moved or removed from the safe. FIG. 4 illustrates one exemplary embodiment of this additional feature as used with a gun vault 40. As shown, each firearm 42-*i* rests upon an associated sensor element 44-*i*, where the plurality of sensors 44 is coupled to control module 12. For example, pressure sensors may be employed, such that if a firearm is lifted off of its associated pressure sensor, an alarm signal will be transmitted to control module 12. Other types of sensors (e.g., optic, acoustic, etc. may be used). For example, if firearm 42-3 is removed from its location, sensor element 44-3 will transmit an alarm signal to control module 12 (specifically identifying the removal of firearm 42-2). Control module 12 is specifically configured in this case to a processor and memory module 48 that maintains a correspondence between each sensor 44-*i* and the identification of the specific firearm 42-*i* stored at that location. When the alarm signal is received, a look-up is performed and control module 12 sends a message to the owner that "Firearm X" has been removed (where "X" is a definition of the specific firearm).

In association with this ability to maintain control of specific items within the safe, it is also possible to include individual locking mechanisms, associated with particular items, where the owner would also need to send a specific control signal to allow a selected item to be removed. As shown in FIG. 4, a separate owner-activated locking mechanism 46-*i* is associated with each firearm 42-*i*. Therefore, if the owner has previously "approved" for firearm 44-2 to be removed by an authorized individual, only that particular firearm will be "unlocked" and mechanism 46-2 opened. This additional layer of security prevents an "authorized" person from removing an "unauthorized" item from the safe.

While contemplated that this feature would be used in conjunction with the motion/touch/open sensors as discussed above, it is possible to configure a notification and control system that only includes these specific firearm alerts, Indeed, further modifications will also occur to those skilled in the art, where such are considered to fall within the spirit and scope of the present invention as defined by the claims appended hereto.

What is claimed is:

1. An interactive notification and alarm system associated with the operation of a safe, the system comprising at least one sensor module for recognizing the occurrence of a predetermined activity and generating an alarm signal when the predetermined activity occurs;

a control module coupled to the at least one sensor module and responsive to the alarm signal generated by the at least one sensor module, the control module initiating a transmission of an alarm message to at least one communication device associated with an owner of the safe, providing an alert of the occurrence of the predetermined activity, the control module further responsive to a return message from the communication device and initiating a predetermined response action only upon receipt of the return message;

at least one item identification sensor module associated with an item located within the safe, such that if the item is removed the identification sensor module is triggered and the owner receives specific information defining the particular item that has been removed; and at least one internal locking mechanism associated with the item, the internal locking mechanism activated via a control signal from the owner, preventing an authorized removal of the item.

2. An interactive notification and alarm system as defined in claim 1 wherein the at least one sensor module comprises a plurality of separate sensor modules, each associated with a different predetermined activity.

3. An interactive notification and alarm system as defined in claim 2 wherein the plurality of separate sensor modules includes one or more sensor modules selected from the group consisting of: a touch sensor module, a motion sensor module, and a sensor module responsive to an attempt to unlock a safe, and a sensor module responsive to an open door of a safe.

4. An interactive notification and alarm system as defined in claim 1 wherein the control module further includes a time-out feature for contacting an emergency response organization if no return message is received in a predetermined period of time after the transmission of an alarm message.

5. An interactive notification and alarm system as defined in claim 1 wherein the control module includes a processor, a memory and a communications element for evaluating an alarm signal received from a sensor module, retrieving a proper alarm message associated with the activated sensor module and retrieving an identity of one or more communication devices associated with the owner such that the communications element is utilized for transmitting the proper alarm message to the designated one or more communication devices.

6. An interactive notification and alarm system as defined in claim 5 wherein the processor and memory elements are further utilized for receiving a return message from the owner's communications devices and retrieving a proper response action associated with the return message.

7. An interactive notification and alarm system as defined in claim 1 wherein the control module initiates a transmission to a single mobile communication device.

8. An interactive notification and alarm system as defined in claim 1 wherein the control module initiates a transmission to a plurality of communication devices.

9. An interactive notification and alarm system as defined in claim 8 wherein the control module initiates to a transmission to one or more communication devices selected from the group of consisting of: mobile telephone, tablet communication device, pad communication device, and computing device.

10. An interactive notification and alarm system as defined in claim 1 wherein the alarm message is in a format selected from the group consisting of: text message, email message, voicemail message, telephone call and SMS message.

11. An interactive notification and alarm system as defined in claim 1 wherein the interactive notification and alarm system further comprises a co-located ON/OFF switch, for use by an owner in controlling the activation of the notification and alarm system.

12. An interactive notification and alarm system as defined in claim 1 wherein the interactive notification and alarm system further comprises a GPS unit to enable tracking of the associated safe.

* * * * *